US007518561B2

(12) United States Patent
Mei

(10) Patent No.: US 7,518,561 B2
(45) Date of Patent: Apr. 14, 2009

(54) DUAL-BAND ANTENNA FOR RADIATING ELECTROMAGNETIC SIGNALS OF DIFFERENT FREQUENCIES

(75) Inventor: Chia-Hao Mei, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 438 days.

(21) Appl. No.: 11/321,250

(22) Filed: Dec. 29, 2005

(65) Prior Publication Data

US 2006/0279464 A1 Dec. 14, 2006

(30) Foreign Application Priority Data

Jun. 10, 2005 (CN) ..... 2005 1 0035298

(51) Int. Cl.
*H01Q 1/24* (2006.01)

(52) U.S. Cl. ..... 343/702

(58) Field of Classification Search ..... 343/702, 343/700 MS, 895, 846–848
See application file for complete search history.

(56) References Cited

U.S. PATENT DOCUMENTS 6,218,991 B1 * 4/2001 Sanad ..... 343/700 MS
6,346,914 B1 * 2/2002 Annamaa ..... 343/700 MS
6,515,629 B1 2/2003 Kuo et al.
7,116,274 B2 * 10/2006 Huang et al. ..... 343/700 MS
7,183,979 B1 * 2/2007 Liu et al. ..... 343/700 MS
7,183,982 B2 * 2/2007 Kadambi et al. ..... 343/702
7,202,822 B2 * 4/2007 Baliarda et al. ..... 343/700 MS

* cited by examiner

*Primary Examiner*—Huedung Mancuso

(57) ABSTRACT

A dual-band antenna for radiating electromagnetic signals of different frequencies includes a ground portion (500), a feeding part (400), a body (100) and a shorting part (200). The feeding part (400) is for feeding signals. The body (100) includes a first radiating part (110) and a second radiating part (120). The first radiating part includes a bent portion (115), a first free end (111), and a first connecting end (112). The bent portion (115) is between the first free end (111) and the first connecting end (112). The first connecting end (111) is electronically connected to the feeding part (400). The second radiating part (120) includes a second connecting end (122) and a second free end (121). The second connecting end (122) is connected to the first connecting end (112). The shorting part (200) is between the body (100) and the ground portion (500).

20 Claims, 8 Drawing Sheets

DUAL-BAND ANTENNA FOR RADIATING ELECTROMAGNETIC SIGNALS OF DIFFERENT FREQUENCIES

BACKGROUND

1. Field of the Invention

The invention relates to antennas such as those used in office equipment and portable electronic devices, and particularly to dual-band antennas for radiating electromagnetic signals of different frequencies.

2. Related Art

Due to increasing market demand for mobile communication products, the development of wireless communication products and systems has rapidly advanced. Many wireless communication standards have been drawn up and implemented. Perhaps the most appealing standard is 802.11, drawn up by the Institute of Electrical and Electronics Engineers (IEEE) in 1997. The IEEE 802.11 standard provides many new functions regarding wireless communication, and provides many new methods for communication between wireless communication products of different companies.

In August 2000, the IEEE amended 802.11 such that 802.11 became a joint standard of the Institute of Electrical and Electronics Engineers (IEEE), the American National Standards Institute (ANSI) and the International Standard Organization (ISO). Furthermore, two more important protocols were added: IEEE 802.11a and IEEE 802.11b. IEEE 802.11a and 802.11g products are expected to work at the dual frequencies of 5 GHz and 2.4 GHz, respectively. Therefore, if a wireless communication product uses the two protocols simultaneously, more than one antenna is required. The addition of one or more antennas, however, not only increases the base cost and installation cost of the communication product, but also means that the communication product occupies more space. This makes it very difficult to reduce the overall size of the wireless communication product to a more convenient size.

SUMMARY

An exemplary embodiment of the invention provides a dual-band antenna for radiating electromagnetic signals of different frequencies. The dual-band antenna includes a ground portion, a feeding part, a body, and a shorting part. The feeding part is for feeding signals. The body includes a first radiating part and a second radiating part. The first radiating part includes a bent portion, a first free end, and a first connecting end. The bent portion is between the first free end and the first connecting end. The first connecting end is electronically connected to the feeding part. The second radiating part includes a second connecting end and a second free end. The second connecting end is connected to the first connecting end. The shorting part is between the body and the ground portion. The above-described configuration can effectively reduce the size of the dual-band antenna.

Other advantages and novel features will become more apparent from the following detailed description when taken in conjunction with the accompanying drawings, in which:

DETAILED DESCRIPTION OF THE EMBODIMENTS

Figure 1:
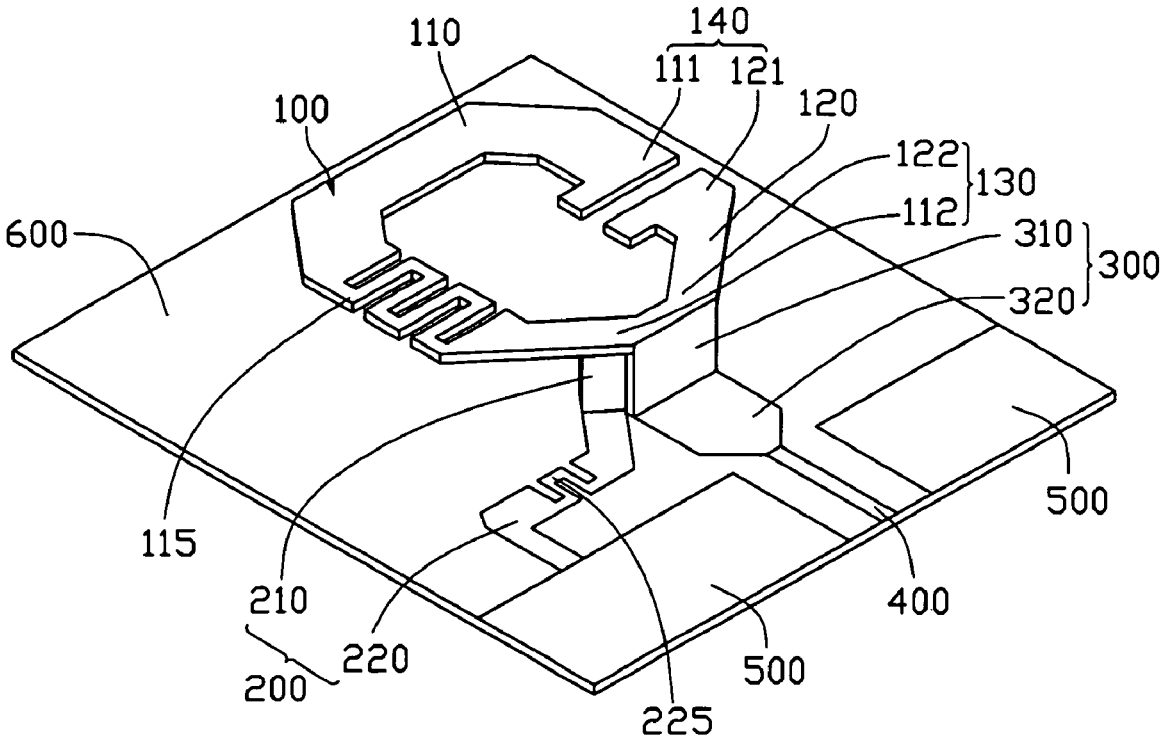
FIG. 1 is a schematic, isometric view of a first exemplary embodiment of a dual-band antenna of the present invention.

FIG. 1 is a schematic, isometric view of a dual-band antenna of a first exemplary embodiment of the present invention. In the first exemplary embodiment, the dual-band antenna is disposed on a substrate 600, and includes a body 100, a shorting part 200, a supporting conductor 300, a feeding part 400, and two ground portions 500. In another exemplary embodiment, the dual-band antenna may not include the supporting conductor 300. In the first exemplary embodiment, the substrate 600 is a Printed Circuit Board (PCB). The feeding part 400 is used for feeding signals. The ground portions 500 are disposed on the substrate 600 on two opposite sides of the feeding part 400 respectively. The body 100 is generally shaped as a polygon with a gap, and includes a first radiating part 110 and a second radiating part 120. In the first exemplary embodiment, the body 100 is made of metal, and the first radiating part 110 and the second radiating part 120 are formed integrally as a single piece. The first radiating part 110 includes a first free end 111, a first connecting end 112, and a bent portion 115. The bent portion 115 is disposed between the first free end 111 and the first connecting end 112. In the first exemplary embodiment, the bent portion 115 is concertinaed. This configuration is also known as a comb-line structure. In the illustrated embodiment, the bent portion 115 is angular; i.e., sharp-cornered. In another exemplary embodiment, the bent portion 115 may be curved, with rounded corners or portions. In still another exemplary embodiment, the bent portion 115 may be both angular and curved; that is, the bent portion 115 may have a combination of angular corners or portions and curved corners or portions.

The second radiating part 120 includes a second free end 121 and a second connecting end 122. The second connecting end 122 is connected to the first connecting end 112, thereby cooperatively forming a joint portion 130. The first free end 111 and the second free end 121 respectively terminate the first radiating part 110 and the second radiating part 120, with the first free end 111 and the second free end 121 opposing each other across a gap therebetween. The first free end 111 and the second free end 121 thereby cooperatively define a capacitive load 140 therebetween. The supporting conductor 300 supports the body 100 above the substrate 600. The supporting conductor 300 includes a vertical part 310, and an adjoining horizontal part 320 on the substrate 600. The vertical part 310 is electronically connected to the joint portion 130, and the horizontal part 320 is electronically connected to the feeding part 400. The shorting part 200 is located adjacent to the supporting part 300 at the first connecting end 112. Further, the shorting part 200 is electronically connected between the body 100 and a nearest one of the ground portions 500. The shorting part 200 includes a supporting part 210, and a planar part 220 adjoining the supporting part 210. The planar part 220 includes a bent portion 225, for effectively reducing the size of the dual-band antenna. In the first exemplary embodiment, the bent portion 225 is concertinaed and angular; i.e., sharp-cornered. In another exemplary embodiment, the bent portion 115 may be curved, with rounded corners or portions. In still another exemplary embodiment, the bent portion 115 may be both angular and curved; that is, the bent portion 115 may have a combination of angular corners or portions and curved corners or portions. The supporting part 210 is electronically connected to the joint portion 130. The planar part 220 is printed on the substrate 600, and is electronically connected to the ground portion 500.

The first radiating part 110, the shorting part 200, the supporting conductor 300 and the feeding part 400 cooperatively form a first planar inverted-F antenna, and the second radiating part 120, the shorting part 200, the supporting conductor 300 and the feeding part 400 cooperatively form a second planar inverted-F antenna. The shorting part 200 can strengthen the radiation capability of the dual-band antenna. A length of the first radiating part 110 is greater than that of the second radiating part 120. Therefore the first planar inverted-F antenna is operated at a lower frequency band, and the second planar inverted-F antenna is operated at a higher frequency band. In the first exemplary embodiment, the first planar inverted-F antenna can be operated at 2.45 GHz (IEEE 802.11b/g), and the second planer inverted-F can be operated at 5 GHz (IEEE 802.11a), such that the frequency bands of the dual-band antenna can conform to IEEE 802.11a/b/g.

The capacitive load 140 can produce an electromagnetic field effect. The electromagnetic field effect can be shared by both of the lower frequency band and the higher frequency band, so that a resonance length of the lower frequency band and the higher frequency band can be effectively reduced. Therefore, the size of the dual-band antenna is effectively reduced. In addition, the bent portion 115 can reduce the rectilinear length of the first radiating part 110 between the first free end 111 and the first connecting end 112 as long as the first radiating part 110 keeps resonating. Therefore, the size of the dual-band antenna is effectively further reduced. Furthermore, the bent portion 115 can produce a coupling effect, thereby strengthening the radiation pattern of the dual-band antenna.

Figure 2:
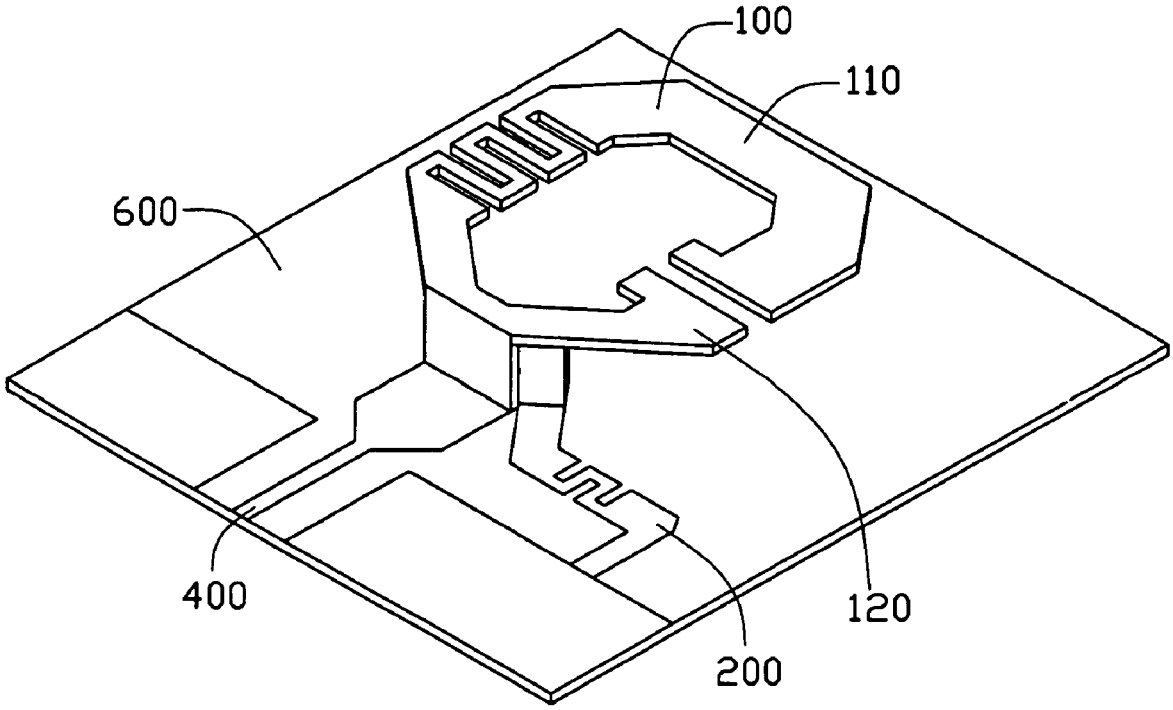
FIG. 2 is a schematic, isometric view of a second exemplary embodiment of a dual-band antenna of the present invention.

FIG. 2 is a schematic, isometric view of a dual-band antenna of a second exemplary embodiment of the present invention. The second exemplary embodiment is similar to the first exemplary embodiment described above, except that the shorting part 200 is located adjacent to the supporting conductor 300 at second connecting end 122.

Figure 3:
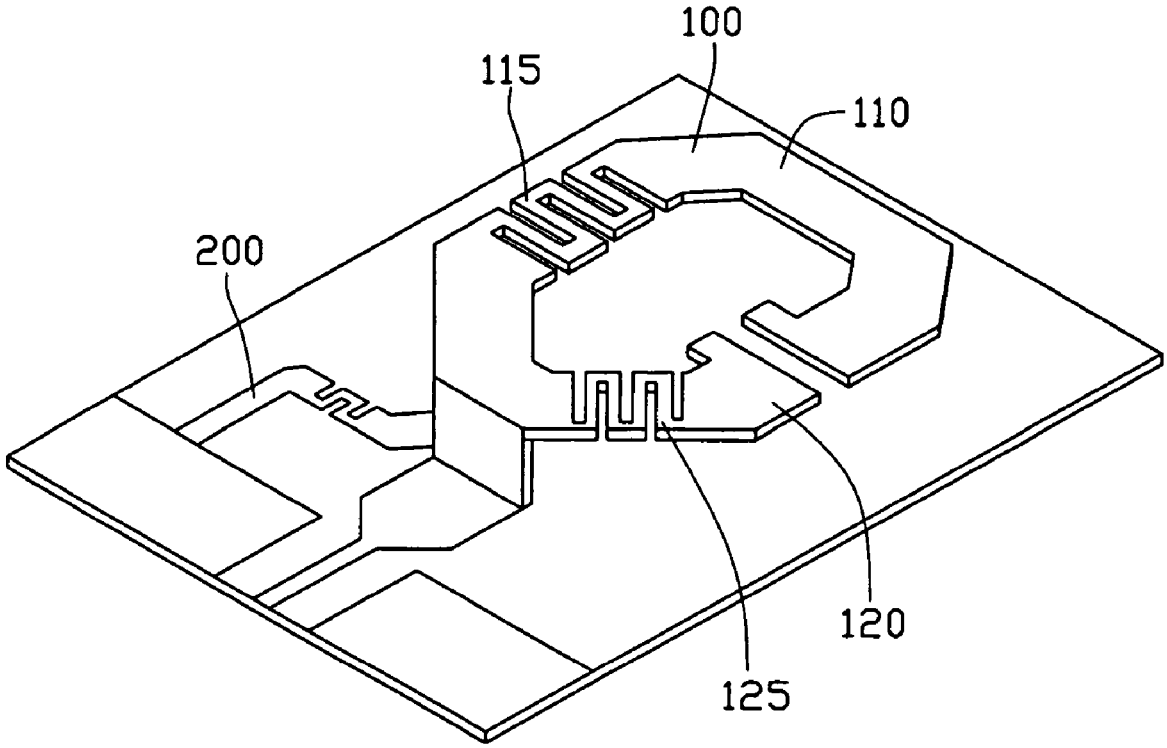
FIG. 3 is a schematic, isometric view of a third exemplary embodiment of a dual-band antenna of the present invention.

FIG. 3 is a schematic, isometric view of a dual-band antenna of a third exemplary embodiment of the present invention. The third exemplary embodiment is similar to the first exemplary embodiment described above. However, the second radiating part 120 includes a bent portion 125, which has the same function as the bent portion 115 of the first radiating part 110. Therefore, the bent portion 125 can effectively reduce the size of the dual-band antenna.

Figure 4:
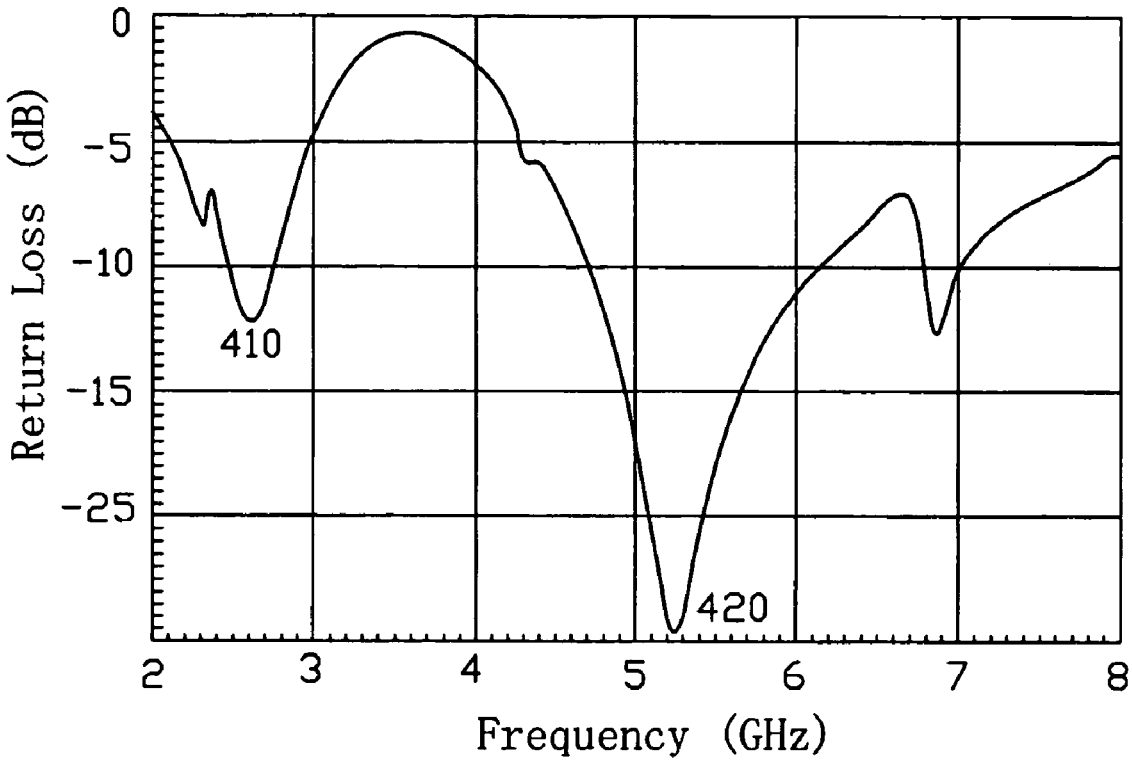
FIG. 4 is a graph of test results showing return loss of the dual-band antenna of FIG. 1.
Figure 5:
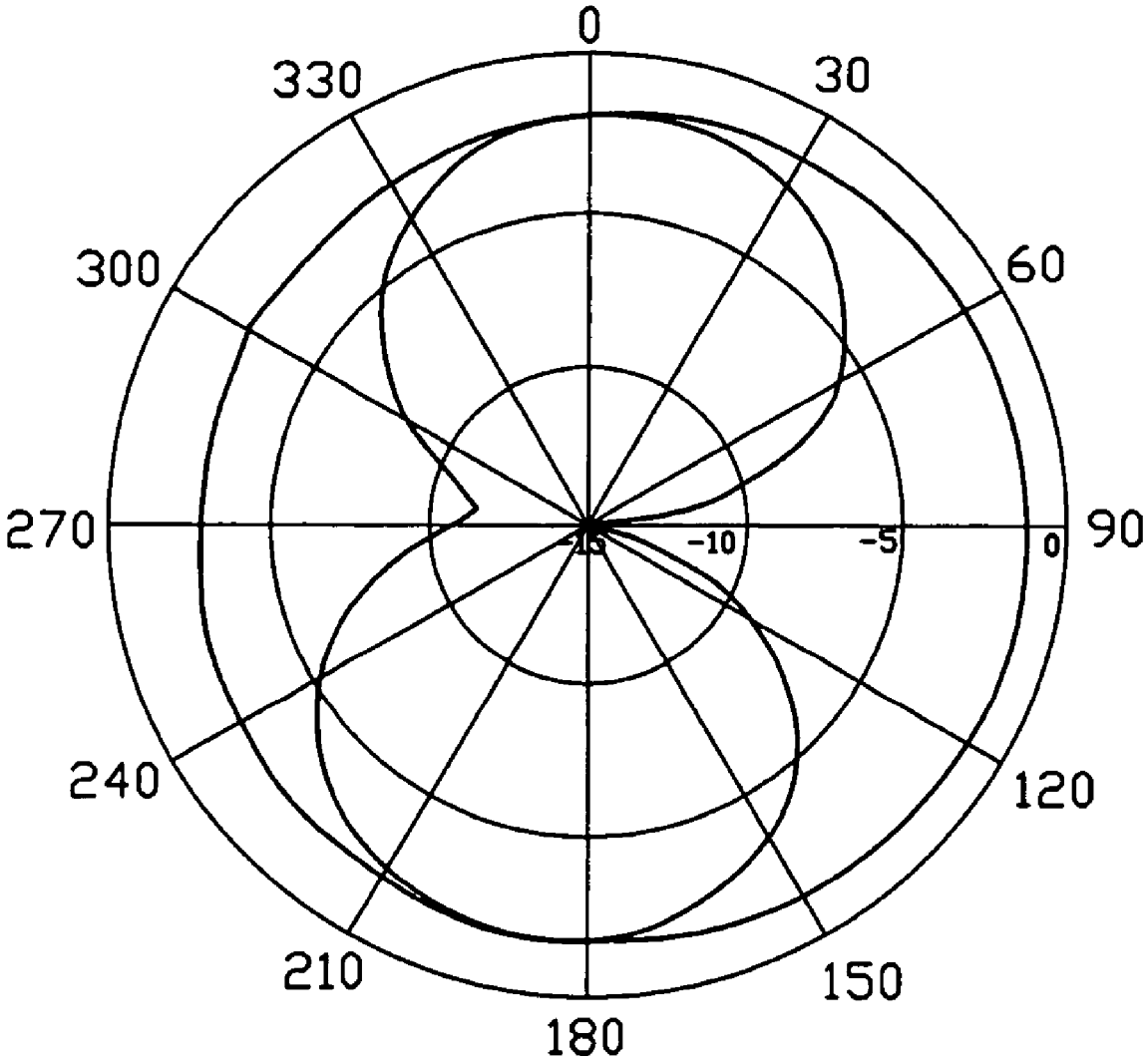
FIG. 5 is a graph of test results showing a radiation pattern when the dual-band antenna of FIG. 1 is operated at 2.45 GHz.
Figure 6:
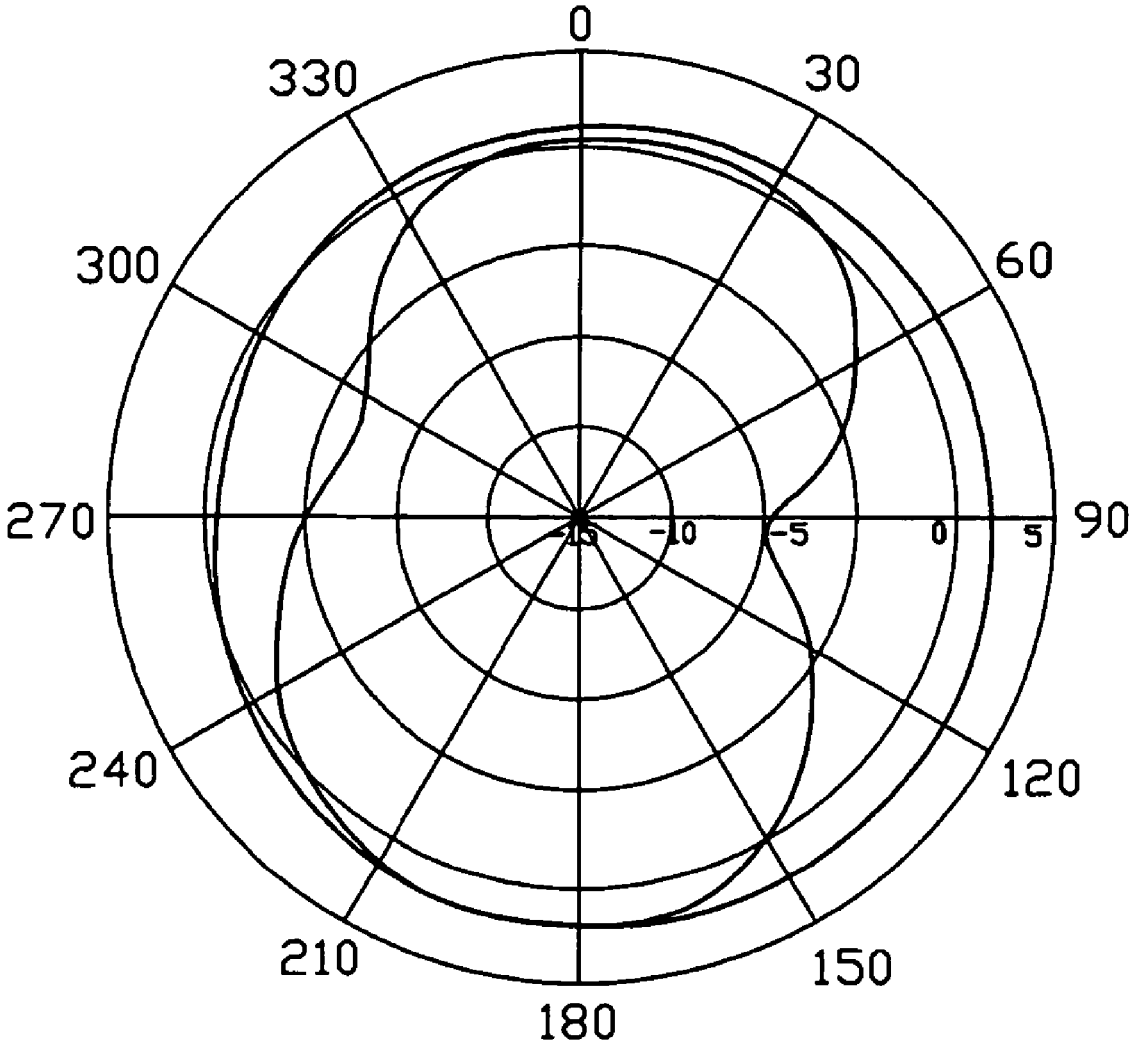
FIG. 6 is a graph of test results showing a radiation pattern when the dual-band antenna of FIG. 1 is operated at 5.0 GHz.
Figure 7:
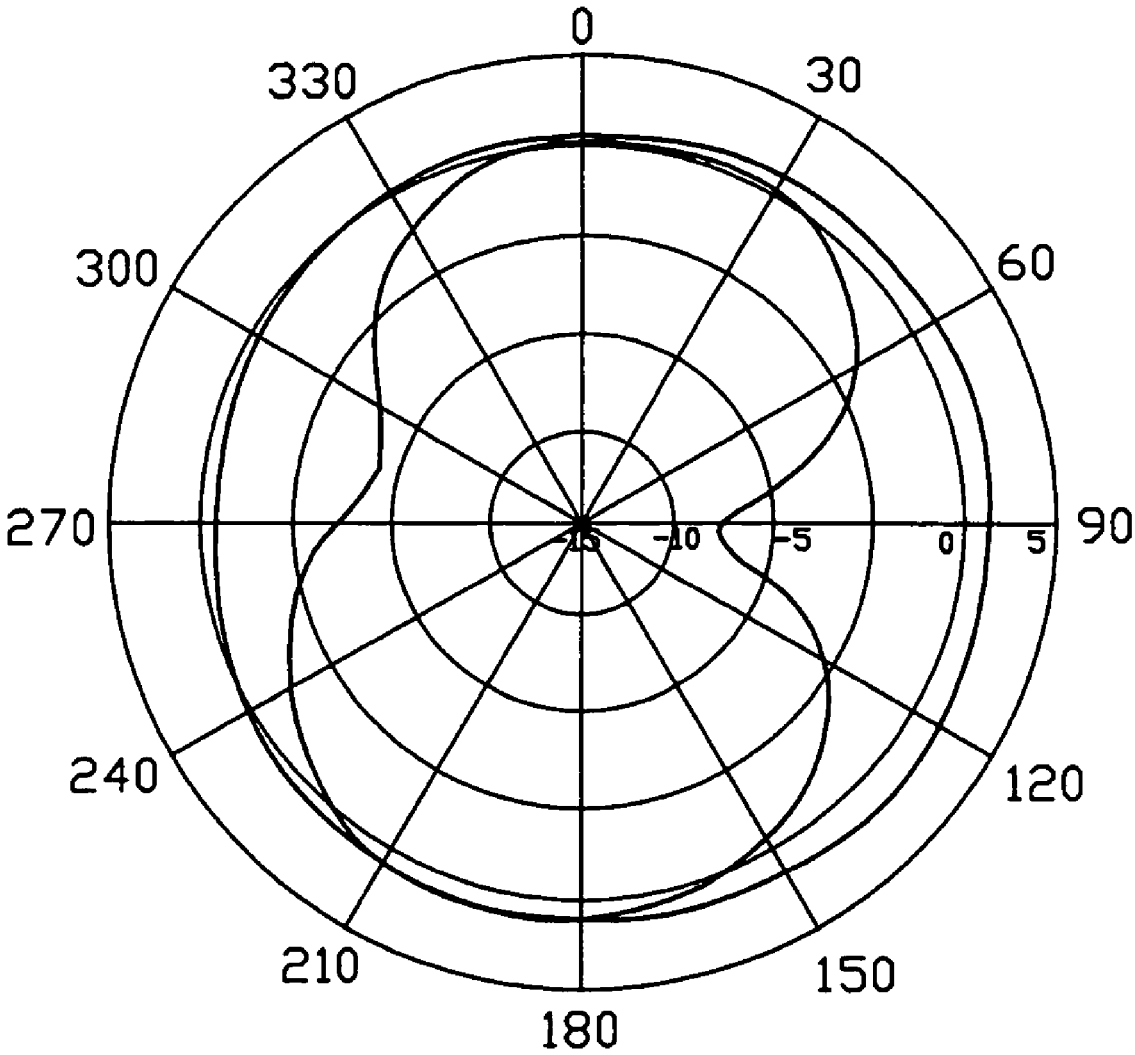
FIG. 7 is a graph of test results showing a radiation pattern when the dual-band antenna of FIG. 1 is operated at 5.5 GHz.
Figure 8:
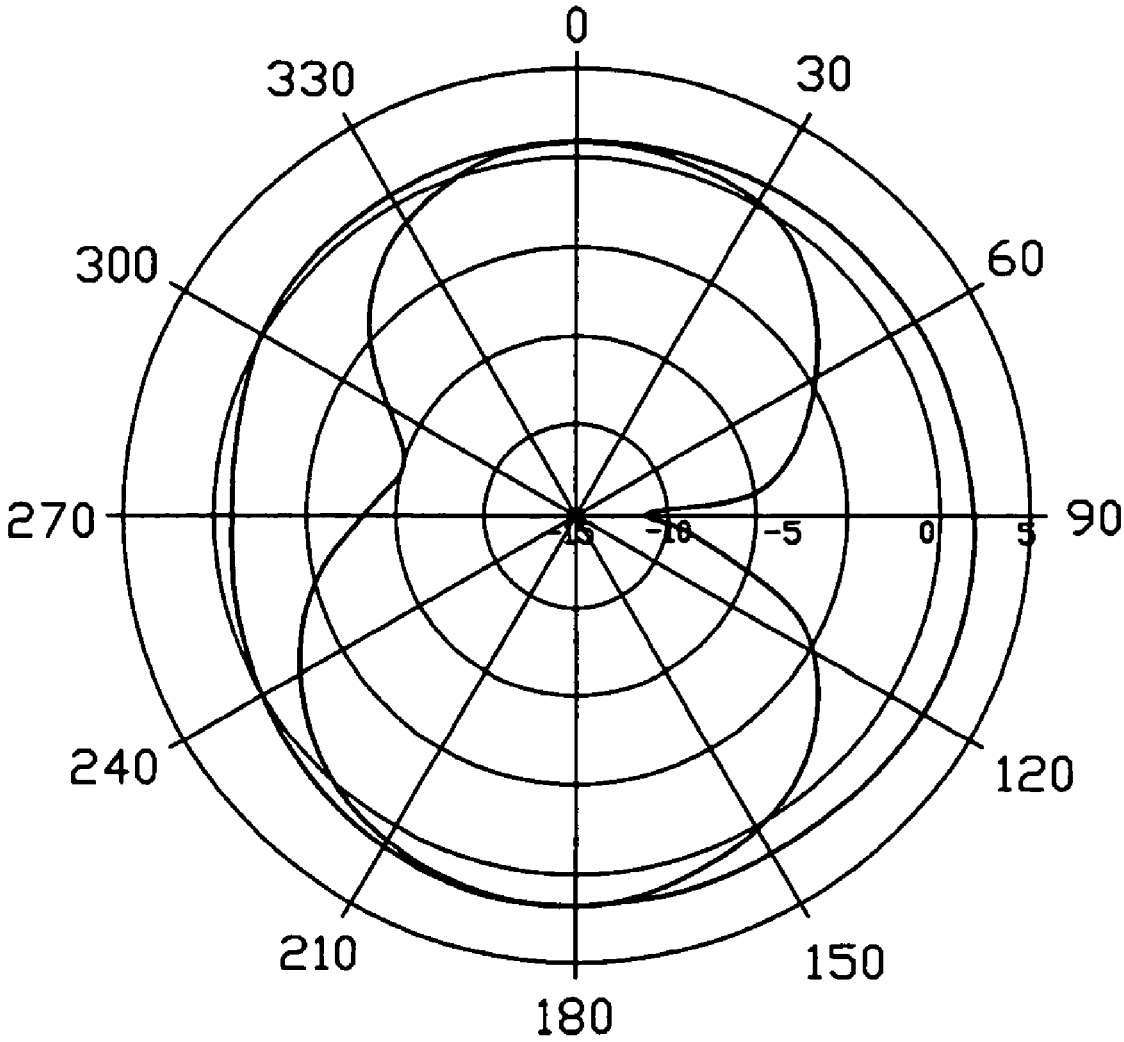
FIG. 8 is a graph of test results showing a radiation pattern when the dual-band antenna of FIG. 1 is operated at 6.0 GHz.

FIG. 4 is a graph of test results showing return loss of the dual-band antenna of the first exemplary embodiment. As shown, the dual-band antenna can be operated at a first frequency band 410 (substantially 2.45 GHz) and a second frequency band 420 (substantially 5-6 GHz). For example, when the dual-band is used in a Wireless Local Network, the first frequency band can conform to IEEE 802.11b/g, and the second frequency band can conform to IEEE 802.11a.

FIGS. 5-8 show radiation patterns when the dual-band antenna of the first exemplary embodiment is operated at 2.45 GHz, 5.0 GHz, 5.5 GHz, and 6.0 GHz respectively. As seen, all of the radiation patterns are substantially omni-directional.

Although various embodiments have been described above, the structure of the dual-band antenna should not be construed to be limited for use in respect of IEEE 802.11 only. When the size and/or shape of the dual-band antenna is changed or configured appropriately, the dual-band antenna can function according to any of various desired communication standards or ranges. Further, in general, the breadth and scope of the invention should not be limited by the above-described exemplary embodiments, but should be defined only in accordance with the following claims and their equivalents.

I claim:

1. A dual-band antenna for radiating electromagnetic signals of different frequencies, comprising:
- a ground portion;
- a feeding part adjacent to the ground portion, for feeding signals;
- a body electronically connected to the feeding part, comprising:
- a first radiating part, comprising a first free end, a first connecting end electronically connected to the feeding part, and a bent portion disposed between the first free end and the first connecting end; and
- a second radiating part, comprising a second connecting end electronically connected to the first connecting end, and a second free end, the second connecting end and the first connecting end cooperatively forming a joint portion;
- a shorting part electronically connected between the joint portion and the ground portion; and
- a supporting conductor electronically connected between the joint portion and the feeding part, for supporting the body, the supporting conductor comprising a vertical part connected to the joint portion and a horizontal part connected to the vertical part and the feeding part.

2. The dual-band antenna as claimed in claim 1, wherein a length of the first radiating part is greater than that of the second radiating part.

3. The dual-band antenna as claimed in claim 1, wherein the shorting part is located adjacent to the feeding part at the first connecting end.

4. The dual-band antenna as claimed in claim 1, wherein the shorting part is located adjacent to the feeding part at the second connecting end.

5. The dual-band antenna as claimed in claim 1, wherein the shorting part includes a supporting part, and a planar part adjoining the supporting part.

6. The dual-band antenna as claimed in claim 5, wherein the supporting part is connected to the joint portion of the first connecting end and the second connecting end.

7. The dual-band antenna as claimed in claim 5, wherein the planar part is connected to the ground portion.

8. The dual-band antenna as claimed in claim 5, wherein the planar part includes a bent portion.

9. The dual-band antenna as claimed in claim 1, wherein the second radiating part further comprises a bent portion between the second connecting end and the second free end.

10. The dual-band antenna as claimed in claim 1, wherein the bent portion has a selective one of an angular concertinaed configuration and a curved concertinaed configuration.

11. The dual-band antenna as claimed in claim 1, wherein the first free end and the second free end face each other across a gap.

12. The dual-band antenna as claimed in claim 1, wherein the first free end and the second free end terminate the first radiating part and the second radiating part, respectively.

13. The dual-band antenna as claimed in claim 1, wherein the first radiating part and the second radiating part are formed integrally as a single piece.

14. A dual-band antenna comprising:

a body of said antenna comprising a first part for radiating and receiving first signals compatible with a first signal standard, and a second part for radiating and receiving second signals compatible with a second signal standard, one extending end of said first part and one extending end of said second part electrically connectable with a joint portion of said body, another extending end of said first part and another extending end of said second parallel spaced from each other so as to exclusively generate electrically capacitive performance between said first and second parts;

a feeding part located on a substrate spaced from said body and electrically connectable with said joint portion so as to transmit said first signals via said first part of said body and transmit said second signals via said second part of said body respectively;

a shorting part electrically connected to said joint portion; and a supporting conductor electrically connected between said joint portion and said feeding part, for supporting said body, said supporting conductor comprising a vertical part electrically connected to said joint portion and a horizontal part on said substrate to electrically connect between said vertical part and said feeding part.

15. The dual-band antenna as claimed in claim 14, wherein said first part is longer than said second part, and said first part and said second part extend to substantially surround a void space therebetween.

16. The dual-band antenna as claimed in claim 14, wherein said shorting part is electrically connected between said joint portion and a ground portion located on said substrate, said shorting part comprises a planar part located on said substrate to electrically connect to said ground portion, and a supporting part to electrically connect between said planar part and said joint portion.

17. The dual-band antenna as claimed in claim 16, wherein a bent portion is formed in said planar part and shaped as one of an angular concertinaed configuration and a curved concertinaed configuration.

18. A dual-band antenna comprising:

a body of said antenna comprising a joint portion, and a first part and a second part branching out of said joint portion, said first part capable of radiating and receiving first signals compatible with a first signal standard and said second part capable of radiating and receiving second signals compatible with a second signal standard, a distal end of said first part and a distal end of said second part extending to confront each other and be arranged in a parallel spaced manner so as to generate capacitive performance thereat;

a feeding part located on a substrate spaced from said body and electrically connectable with said joint portion so as to transmit said first signals via said first part of said body and transmit said second signals via said second part of said body respectively;

a shorting part electrically connected to said joint portion; and a supporting conductor electrically connected between said joint portion and said feeding part, for supporting said body, said supporting conductor comprising a vertical part electrically connected to said joint portion and a horizontal part on said substrate to electrically connect between said vertical part and said feeding part.

19. The dual-band antenna as claimed in claim 18, wherein said shorting part is electrically connected between said joint portion and a ground portion located on said substrate, said shorting part comprises a planar part located on said substrate to electrically connect to said ground portion, and a supporting part to electrically connect between said planar part and said joint portion.

20. The dual-band antenna as claimed in claim 19, wherein a bent portion is formed in said planar part and shaped as one of an angular concertinaed configuration and a curved concertinaed configuration.

* * * * *